United States Patent [19]

Pailler

[11] Patent Number: 4,812,060

[45] Date of Patent: Mar. 14, 1989

[54] APPARATUS FOR PROCESSING CARD TICKETS, IN PARTICULAR TRAVEL TICKETS INCLUDING A MAGNETIC TRACK

[75] Inventor: Alain L. Pailler, Verrieres Le Buisson, France

[73] Assignee: Electronique Serge Dassault, Saint Cloud, France

[21] Appl. No.: 77,691

[22] Filed: Jul. 24, 1987

[30] Foreign Application Priority Data

Jul. 30, 1986 [FR] France ..... 8611058

[51] Int. Cl.[4] ..... B41J 3/54

[52] U.S. Cl. ..... 400/82; 400/124; 400/605; 101/93.04; 101/93.12

[58] Field of Search ..... 400/605, 82, 124; 101/93.11, 93.12, 93.04; 271/301, 303

[56] References Cited

U.S. PATENT DOCUMENTS

| | | | |
|---|---|---|---|
| 3,283,874 | 11/1966 | Goreham | 271/9 |
| 3,815,897 | 6/1974 | Hoehl | 400/82 |
| 4,431,322 | 2/1984 | Nally et al. | 400/605 |
| 4,537,125 | 8/1985 | Gaueber | 101/93.04 |
| 4,556,334 | 12/1985 | Pailles | 400/124 |
| 4,619,197 | 10/1986 | Pailles | 101/93.04 |
| 4,694,307 | 9/1987 | Togaroh et al. | 400/82 X |

FOREIGN PATENT DOCUMENTS

| | | | |
|---|---|---|---|
| 0169745 | 1/1986 | European Pat. Off. | 400/82 |
| 1280605 | 10/1968 | Fed. Rep. of Germany | 400/82 |
| 2398354 | 2/1979 | France | 400/82 |
| 2566704 | 1/1986 | France | 400/82 |
| 102388 | 6/1982 | Japan | 400/82 |
| 220777 | 12/1983 | Japan | 400/82 |
| 94364 | 5/1985 | Japan | 400/82 |
| 259471 | 12/1985 | Japan | 400/82 |

*Primary Examiner*—Edgar S. Burr
*Assistant Examiner*—James R. McDaniel
*Attorney, Agent, or Firm*—Christie, Parker & Hale

[57] ABSTRACT

Apparatus for processing card tickets includes a printing and/or encoding module (1), having means for driving a ticket along a path internal to the module (1) in order to pass it through a ticket print station and, where appropriate, a ticket encoding station (160), and then to a ticket outlet between two wheels (150, 193). A second module (2) is provided, similar to the first, and coupling means (3) are provided between the respective outlets from the two modules (1, 2) and an outlet receptacle (370) in order to take tickets from one or other or both of the modules (1,2) and stack them in the receptacle (370).

14 Claims, 1 Drawing Sheet

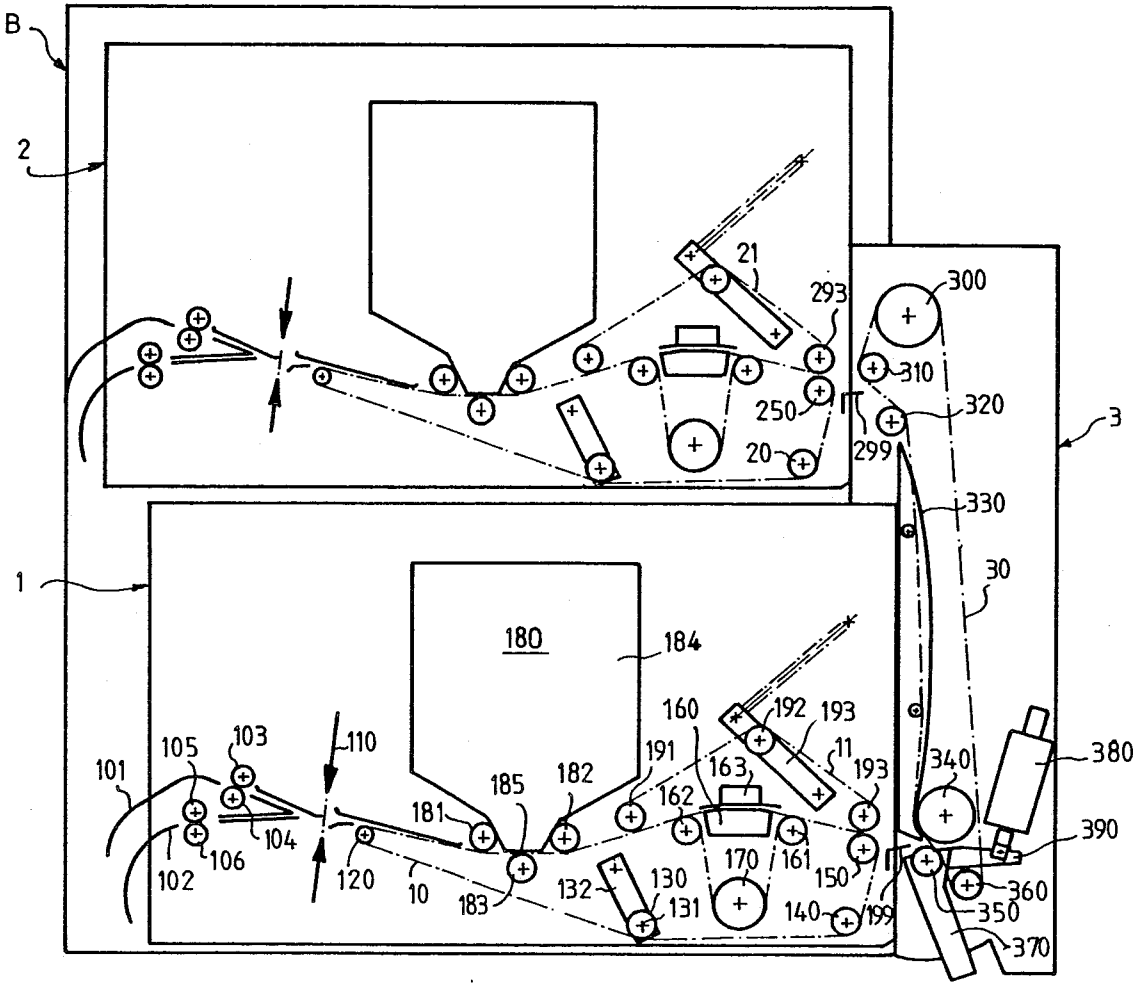
3
380
390
360
350
370
300
320
330
30
340
310
299
199
293
250
20
21
193
11
192
150
161
140
163
170
160
162
130
131
184
191
182
132
180
185
183
181
10
110
120
104
103
106
105
102
101
B
2
1

APPARATUS FOR PROCESSING CARD TICKETS, IN PARTICULAR TRAVEL TICKETS INCLUDING A MAGNETIC TRACK

The invention relates to apparatuses for processing card tickets, such as travel tickets or the like.

BACKGROUND OF THE INVENTION

Many modern travel tickets are made of a paper medium which is reinforced to a greater or lesser extent in order to be suitably rigid. The term "card ticket" is used herein to designate such a medium, which is usually provided with a magnetic strip or track. In some cases, the ticket may also have lines of weakness enabling it to be split up into a plurality of coupons for inspection purposes.

In general, the processing of such tickets begins with making a valid ticket from a blank data medium, and continues with one or more ticket inspection operations, optionally terminating with a ticket cancelling or invalidating operation, once it has been used.

The problem faced by the Assignee consists in providing apparatus capable of simultaneously printing and magnetically writing and/or encoding on such a ticket, with the apparatus being as simple as possible magnetically and reliable even when presented with damaged tickets, with the cost of such apparatus being reasonable for the intended kinds of application.

More specifically, such apparatus must be capable of printing, encoding, and issuing a plurality (generally ten) of travel tickets as a wad or booklet under conditions which are completely acceptable for dispensing such wads of tickets. The time taken should be about twenty seconds or, better, about ten.

If such apparatuses are to be very effective and very fast they are necessarily very expensive and are thus pointless for the types of application envisaged.

Further, a high performance apparatus is still in danger of going out of service. The Assignee has sought to mitigate this problem related to breakdowns.

One of the aims of the present invention is to provide processing suitable for dispensing a set of tickets under conditions which are quite acceptable and more quickly than using conventional processing apparatuses.

Another aim of the invention is to mitigate the effects of operating breakdowns by ensuring that dispensing continues to take place even when a portion of the apparatus has broken down.

Another aim of the invention is to increase the time during which the apparatus can run unattended compared with conventional processing apparatuses.

SUMMARY OF THE INVENTION

These problems have been solved on the basis of apparatus for processing card tickets comprising a printer and/or encoding modules having drive means for driving a ticket along a path inside the module to cause it to pass through a print station and, where applicable, through a ticket-encoding station, and then to a ticket outlet between a pair of wheels.

According to the invention, the apparatus includes the improvement of:

a second module similar to the first; and coupling means provided between the respective outlets from the two modules and an outlet receptacle in order to take tickets from one or other or both of the modules and to stack them in the receptacle.

Advantageously, the two modules are disposed in parallel with each other, whereas the coupling means are placed facing the outlets from the modules and perpendicular to the assembly of said two modules.

In one particular embodiment of the invention, the coupling means include a taut belt running round a closed circuit over wheels and pressing against a guide member over at least a portion of its path between the outlets of the two modules.

More specifically, said guide member comprises a plate which is substantially convex on the side where the belt presses thereagainst except for in the vicinity of that one of its ends which is closer to the receptacle, which end is concave so as to receive a wheel of the coupling means over which the belt passes.

It is advantageous for the belt to be friction-driven by a stepper motor.

Preferably, the belt is disposed substantially perpendicularly to the internal ticket path through the last processing stage in each module.

In the preferred embodiment of the invention, the outlet from one or other of the modules comprises a pair of wheels which are substantially tangential to each other and which are aligned parallel to the axis of the coupling means and which have respective belts passing therearound, a backing member being situated at the interconnection between each module and the coupling means.

More specifically, a ticket is transferred from the module which is further from the receptacle within the coupling means by a pair of wheels which are offset relative to each other and which are spaced apart at a distance which is shorter than the length of a ticket, a first one of said pair of wheels and the backing member forming a tapering channel suitable for enabling a ticket to be guided by the belt into the coupling means, with the second wheel of the pair ensuring that the ticket is directed towards the guide member.

Similarly, a ticket is transferred from the module which is closer to the receptacle by the outer edge of the guide member and the backing member constituting a tapering channel enabling a ticket to be inserted into the coupling means, and by a second wheel enabling the ticket to be conveyed into the receptacle.

Advantageously, tickets are transported by being compressed between the belt and the wheels or between the belt and the guide member, with the spacing between any two adjacent wheels or between a wheel and the guide member being less than the length of each ticket. According to another optional feature of the invention, the outlet receptacle comprises a temporary receptacle rotatably mounted on a plate of the coupling means and actuated by an electromagnet, said temporary receptacle maintaining the tickets to be extracted by holding their bottom portions.

In accordance with an aspect of the invention, the drive means for at least one of the modules comprise a toothed belt pressing against wheels over which it is curved round a closed circuit, with pairs of adjacent wheels being spaced apart at a distance which is less than the length of a ticket, with the belt bypassing the encoding station via a return wheel to allow the ticket to be driven through the encoding means by a secondary belt, which is itself held taut over a plurality of wheels and which co-operates with the first belt by friction.

In accordance with another aspect of the invention the encoding station includes two magnetic heads, one for reading and the other for writing.

Another advantage of the apparatus is that the means for inserting card tickets into each module comprise two guide channels for tapes supplied from two respective reels, said guide channels converging towards each other.

In a preferred embodiment of the invention the print station comprises a dot matrix printer facing a roll forming a print platen, with two wheels placed respectively upstream and downstream from the print means and with the module drive belt passing over said wheels, with printing being performed both along the length of the ticket which is then made to reciprocate repetitively, as well as across the width thereof.

Finally it is advantageous for each module to include cutter means including a blade and a backing blade, said cutter means being actuated by an electromagnet.

BRIEF DESCRIPTION OF THE DRAWINGS

An embodiment of the invention is described by way of example with reference to the accompanying drawing, in which the sole figure is a diagrammatic side view of processing apparatus in accordance with the present invention.

MORE DETAILED DESCRIPTION

In the figure, reference B is a general reference for the housing of the apparatus, while references 1, 2, and 3 designate its main component parts, i.e. respectively: the first processing module; the second processing module; and the coupling means.

The two modules 1 and 2 are processing modules similar to those already described in French patent application number 84 10379, published under the number 2 566 704. The only differences lie with their interfaces with the coupling means, and these are described in detail below. In a particular embodiment of apparatus in accordance with the invention, the modules 1 and 2 are identical. Thus only the module 1 is described.

The module 1 is capable of printing on, of encoding on, of reading from, and of cutting a ticket.

Two reels (not shown) of card/paper tape feed two inlet deflectors 101 and 102 respectively. Such a reel feed makes it possible to locate a paper/card storage magazine in any convenient position relative to the remainder of the apparatus.

The tape is inserted via two guide channels which converge towards each other and which are provided with separate drive means constituted by stepper motors.

A wheel 104 located between the two walls of the first channel extending the deflector 101 co-operates by friction with a wheel 103 mounted on, the shaft of the first stepper motor (not shown). Similarly a wheel 105 in the second channel co-operates by friction with a wheel 106 mounted on the shaft of the second stepper motor (not shown). A set of appropriate detectors determines whether proper insertion has taken place in each inlet channel. Tape is conveyed to the above-mentioned convergence point by only one channel at a time.

One or other of the two inlet channels thus conveys tape which will bear against another deflector (not shown) at the convergence point. A cutter part constituted by a blade and a blade backing member under the control of an electromagnet then cuts the tape to a predetermined length.

The ticket now enters the "internal path" of the processing module.

Before describing the remainder of the ticket path, the dynamics associated with the belt 10 should be described. On the far right, the belt passes over a drive wheel 150 which is a toothed wheel co-operating with the belt. It returns initially downwardly over a wheel 140 and then passes over a wheel 130 which is pivotally mounted at 131 on an arm 132 under resilient bias from a spring (not shown). The tension of the belt 10 can be adjusted (if necessary) either by adjusting the position at which the spring is fixed to the arm, or else by selecting a different spring.

The belt 10 then goes round the initial wheel or inlet wheel 120 after which there begins the internal path followed by tickets going through the apparatus.

The belt 10 first encounters a print station 180. This print station comprises a dot matrix printer constituted by a block 184 having a seven-pin print head 185. The assembly 184 and 185 is movable from one end to the other of a generator line of a platen roll 183 situated opposite the head 185. Such transverse motion is communicated to the head 185 by a stepper motor (not shown). This makes it possible to give any desired configuration to printing on the ticket. The roll 183 has a smooth outer surface provided on one side with a step which may also be smooth and which is dimensioned so as to receive the belt 10 exactly so that the belt comes level with the generator line on the roll 183.

The ticket passes through the print station between wheels 181 and 182. The printer has a spool (not shown) for supplying it with an inking ribbon, said spool moving with the printer. The spool is mounted in a cassette and the ribbon is 8 mm wide. It is driven by a DC motor. It turns out that a dot matrix printer of the type described above is capable of printing at least twenty thousand tickets per ribbon with proper inking.

The ticket also receives printing lengthwise. It may be scanned several times over if a plurality of lines are to be printed.

Printing then takes place column by column. Such dot-matrix printing can be used in conventional manner to build up a plurality of horizontal print lines on the ticket. Naturally, printing could also be provided the other way around (transverse moment) and either or both ways up.

After passing through the print station, the belt is deflected by a wheel 191. It then goes around a wheel 162 and moves away from the internal ticket path towards a return wheel 170 prior to returning via a wheel 161, with the internal ticket path terminating at the above-mentioned final wheel 150 operating in conjunction with a wheel 193 which is tangential to the wheel 150 so as to avoid deflecting the belt 10.

The belt is moved away from the path between the wheels 162 and 161 in order to leave room for two magnetic heads 160, one for reading and the other for writing, which heads project into the internal ticket path. A plate 163 together with the heads 160 forms a channel through which the ticket passes.

The magnetic inscriptions correspond to data written in the clear, together on most occasions with other, additional information.

A second belt 11 passes opposite the magnetic heads. The belt 11 follows a closed loop round wheels 191, 192, and 193. It is not to be directly driven and it need not be toothed. The wheel 191 presses the belt 11 against the belt 10 with sufficient pressure to ensure that the ticket remains in cooperation with the belt 10, given that it may slide relative to the belt 11. Over the magnetic heads 160, it is the belt 11 on its own which ensures that the travel ticket and its magnetic track is maintained with suitable pressure against the heads 160. The length of the plate 163 is chosen so that the ticket always remains in contact with the belt 10, thereby ensuring that its drive is continuous and without slip. More precisely, the ticket is initially pushed by the belt 10 upstream from the wheel 162. It moves forwards to pass over the magnetic heads while being pressed thereagainst by the belt 11. It continues to advance under thrust from the belt 10, given that the belt 11 is normally driven at the same linear speed as the belt 10. Before its rear edge has left the wheel 162, its leading edge has engaged the wheel 161 and thus comes back into contact with the belt 10 while continuing to be driven by the belt 11.

Along the internal ticket path where the ticket is pinched between the belt 10 and a wheel, the belt 10 forms an angle of about 165° around each wheel. This applies to the wheels 181, 82, 191, and 193, and preferably also applies with respect to the second belt 11 where it passes over wheels 161 and 162.

In this way, the traction force exerted by friction on the ticket as it passes each wheel is very regular and is hardly affected by the thickness of the ticket. It is essentially defined by the spring acting on the arm 132.

It has been observed that such a disposition ensures excellent printing and also excellent accuracy in ticket displacement, or more particularly in this case in the displacement of the ticket's magnetic track past the magnetic heads.

This displacement accuracy is very important for ensuring that magnetic characters are properly written to or properly read from said track. Another very important item is the pressure at which the ticket is applied against the magnetic heads 160, which is ensured in this case by the belt 11.

It may be observed that the wheel 192 is rotatably mounted on an arm 194 which is itself pivoted on a plate (not shown). A spring can exert a desired traction thereon and this may optionally be adjustable by adjusting the point at which the other end of the spring is fixed to said plate. This makes it possible to adjust the tension of the belt 11, and consequently to adjust the pressure with which the tickets are applied against the magnetic heads 160.

The above-described module 1 constitutes a highly advantageous solution to the problem consisting in providing inscriptions which are readable by the human eye together with magnetic inscriptions on a card ticket having a magnetic track, while additionally enabling the card ticket to be read, such a ticket generally being for travel purposes. Preferably, both belts 10 and 11 are situated level with the magnetic track.

The set of belts may be driven simply from the wheel 150 which is itself driven by a stepper motor, or by a DC motor with speed regulation provided by a tachometer generator. The second belt is driven by friction against the first, through the ticket, where appropriate.

With a module of the type described above, the Assignee has been able to obtain displacement accuracy which is better than one micron for a maximum speed of displacement of about 500 mm per second. These figures relate to displacement of the ticket per se. In this embodiment the belt has a pitch of 2.032 mm. It is made of neoprene. The roll 150 has a diameter of 36 mm.

The ticket used is 20 cm×8 cm. Its magnetic track satisfies ISO standards.

Given these dimensions, it will be seen that the ticket is guided entirely by co-operation with the belt. However, given the length of the ticket, a condition that must be satisfied is that it remains continuously pinched between one or two wheels and the belt which drives it from the inlet to the outlet. The gaps between the wheels are chosen to satisfy this condition.

In the embodiment shown in the figure, the module 2 is identical to the module 1. The internal path directions of the two modules are disposed in parallel. The two-module assembly is installed in the housing B. The housing may be horizontal or vertical.

If the tickets written to or read from by the magnetic heads 160 have a magnetic coding defect, they may be directed to a reject receptacle. Such a disposition is not shown in the figure, but may be taken from the assignee's U.S. patent application Ser. No. 672,184 filed on Nov. 11, 1984.

Coupling means are connected to the outlets from the two modules 1 and 2. They serve to convey a ticket processed by one or other of the modules towards a common outlet receptacle. Processing apparatus which thus includes two modules interconnected by suitable coupling means as described below can double the speed at which tickets are dispensed. Typically, the time required to dispense ten tickets (a wad or "booklet" of tickets) is thirteen seconds.

Furthermore, if one or other of the modules stops or breaks down, ticket dispensing does not cease, it merely takes place more slowly.

The coupling means are referenced 3 in the figure. They comprise drive means extending substantially perpendicularly to the internal paths followed by tickets through the modules 1 and 2. These coupling means are thus placed perpendicularly to the axes of the internal paths within the two modules.

The coupling means include a belt 30. At the top of the figure the belt 30 passes over a drive wheel 300. This wheel is mounted on the shaft of a stepper motor (not shown). The belt then runs over a wheel 310, another wheel 320 offset slightly behind the wheel 310 so that the belt angle containing the wheel 310 is about 130°, whereas the belt angle containing the wheel 320 is about 170°. These two wheels 310 and 320 are disposed facing the outlet from the module 2.

The belt 30 then extends substantially perpendicularly to the common direction of the internal paths through the modules 1 and 2. It is then pressed against a guide member 330 in the form of a plate which is slightly convex apart from its end nearest to the outlet from the module 1 which has a concave portion.

The convex shape of this guide member enables the belt to be applied thereagainst with pressure. The plate is sufficiently long to cover the space between the two module outlets. Its non-curved surface is applied directly to the short side of the module 1. Given its changing curves, its two ends are of different appearance. Close to the module 2 the plate has a tapering end, whereas its opposite end has an oblique outer edge at an obtuse angle to the base of the plate.

A wheel 340 of the same radius as the radius of curvature of the concave portion of the plate 330 is received therein so as to press the belt against the plate 330.

The belt then passes over a wheel 350 and finally goes round a wheel 360 before returning to the above-mentioned wheel 300.

A part 370 is pivotally mounted on the same axis as the wheel 350. It is actuated by an electromagnet 380. In its rest position the part 370 constitutes a temporary receptacle for collecting tickets.

When actuated, the part pivots and thus allows tickets to drop into the outlet receptacle from the machine containing the ticket processing apparatus.

In the preferred embodiment described, the internal ticket path through the module 1 or 2 terminates at the wheels 150 and 193 (or 250 and 293). In this respect, it turns out that a suitable relative disposition for the wheels 150 and 193 (or 250 and 293) is one which allows the ticket to leave tangentially to said wheels 150 and 193.

As described above, the pairs of wheels 150 and 193 (or 250 and 293) are tangential to each other and the alignment of their axes is parallel to the main axis of the coupling means.

Further, appropriate outputting of the ticket is facilitated by the actions of the pair o±belts 10 and 11 (or 20 and 21).

The ticket thus appears at the outlet at a substantial angle relative to the axis of the module. Two situations may arise depending on whether the module 1 or the module 2 is being used.

If the module 2 is being used, a backing member 299 cooperates with the belt 30 where it passes between the wheels 310 and 320 to form a tapering outlet channel. The ticket is pinched between the backing member 299 and the belt 30 which, in operation, rotates counterclockwise. The ticket then passes between the belt 30 and the wheel 320 which is directly adjacent to the backing member 299 and to the wheel 310. It should be observed that the spacings between the outlet wheels 293, 250, the backing member 299, and the wheels 310 and 320 are such that the ticket remains in engagement with one or more of these parts as it passes therethrough. The ticket is then guided along the convex profile of the plate 330 between the plate and the belt 30, being driven simply by friction from the drive wheel 300. The ticket then passes beneath wheel 340 into the concave portion at the end of the plate 330. Thereafter it is guided by the wheel 350, then the wheel 360 and finally arrives in the temporary receptacle 370. It is held therein by its bottom portion with the electromagnet 380 actuated the appropriate way to ensure that tickets remain in the temporary receptacle.

The inlet to the coupling means from the module 1 is provided in a rather different manner.

The outside edge of the plate 330 together with a backing member 129 (identical to the member 299) forms a tapering outlet channel. As for the module 2, the backing member 199 is disposed at the interconnection between the coupling means and the module 1. The ticket leaving the module 1 is thus guided by the outlet channel and engages the belt 30 which pinches it against the wheel 350. It is then guided over the wheel 360 prior to terminating its travel in the temporary receptacle 370 as described above.

An external control unit synchronizes operations so as to ensure that two tickets never arrive simultaneously at the point where the two paths converge between the wheel 340 and the wheel 350. However, even if this should happen, the combined thickness of both tickets is not sufficient to prevent the belt 30 from operating properly.

The above-described apparatus has further advantages in addition to those described above:

The apparatus can be used to process pre-fabricated tickets. If the coding station and the printing station are interchanged along the internal path, the ticket can initially be read by the magnetic read head and can then be printed on, depending on the instructions obtained by reading its magnetic track.

Only one module of the apparatus need be used on any one occasion. For example season or contract tickets require only one printing and coding operation. In such a case only one of the modules performs the operation. For example, it may be undertaken by a module having a feed from a reel of a special color or material designated for issuing such season tickets.

The apparatus can operate for a long time without attention. It is suitable for receiving tape from four supplies, rather than from two supplies as is conventional, and no mechanical switching between tape insertion channels is required, nor are there any constraints on the positioning of the tape supplies relative to the printing mechanisms.

It may be provided with a magazine of pre-cut ticket blanks, in which case the cutter is not used and the magazine of blanks is inserted in each module instead of its inlet deflectors.

An electronic control unit (not shown) ensures that the stepper motors are controlled as a function of the state of various detectors likewise not shown) which are generally constituted by opto-electronic means placed at locations where one or other condition may occur or where a signal is required, e.g. for timing purposes. The control unit is also in communication with the control logic for the print station and for the coding station.

The electronic control unit ensures not only that operations take place in sequence, but also keeps count of the tickets issued and synchronizes ticket dispensing. When the required number of tickets has been issued, the apparatus stops.

Naturally, the present invention is not limited to the embodiment described and extends to any variant included within the scope of the following claims. Further, it is suitable for being combined with the subject matter of the assignee's following U.S. patent application Ser. No. 672,184 "Card ticket processing apparatus suitable for issuing and/or inspecting a ticket"; U.S. Pat. No. 4,556,334 issued on Dec. 3, 1985 "Anvil print apparatus, in particular for travel tickets"; and U.S. Pat. No. 4,537,125 issued on Aug. 27, 1985 "Apparatus for processing card tickets, in particular travel tickets having a magnetic track".

I claim:

1. Apparatus for processing card tickets, the apparatus including a pair of similar printing and/or encoding modules each having at least one station for printing on a ticket or for encoding a ticket, together with means for driving a ticket along a path internal to the module in order to pass it through said station and then to a ticket outlet defined between two wheels, the apparatus further including:

coupling means provided between the respective outlets from the two modules and an outlet receptacle in order to take tickets from one or the other or both of the modules and to stack the tickets in the receptacle;

each module having a separate inlet with means for inserting tickets into the respective module inlets from separate supply reels;

two modules being disposed substantially in parallel with each other, a guide member extending between the outlets of the two modules wherein the coupling means including a taut belt running in a closed circuit over wheels and pressing against said guide member over its path between the outlets of the two modules, and the belt of the coupling means facing the outlets from the modules and extending substantially perpendicularly to the assembly of the two modules.

2. Processing apparatus according to claim 1, wherein said guide member comprises a plate which is substantially convex on the side where the belt presses thereagainst except for in the vicinity of that one of its ends which is closer to the receptacle, which end is concave so as to receive a wheel of the coupling means over which the belt passes.

3. Processing apparatus according to claim 1, wherein the belt is friction-driven by a stepper motor.

4. Processing apparatus according to claim 1, wherein the belt is disposed substantially perpendicularly to the internal ticket path through the last processing stage in each module.

5. Processing apparatus according to claim 1, wherein the outlet from one or other of the modules comprises a pair of wheels which are substantially tangential to each other and which are aligned parallel to the axis of the coupling means and which have respective belts passing therearound, a backing member being situated at the interconnection between each module and the coupling means.

6. Processing apparatus according to claim 5, wherein a ticket is transferred from the module which is further from the receptacle within the coupling means by a pair of wheels which are offset relative to each other and which are spaced apart at a distance which is shorter than the length of a ticket, a first one of said pair of wheels and the backing member forming a tapering channel suitable for enabling a ticket to be guided by the belt into the coupling means, with the second wheel of the pair ensuring that the ticket is directed towards the guide member.

7. Processing apparatus according to claim 5, wherein a ticket is transferred from the module which is closer to the receptacle by the outer edge of the guide member and the backing member constituting a tapering channel enabling a ticket to be inserted into the coupling means, and by a second wheel enabling the ticket to be conveyed into the receptacle.

8. Processing apparatus according to claim 1, wherein tickets are transported by being compressed between the belt and the wheels or between the belt and the guide member, with the spacing between any two adjacent wheels or between a wheel and the guide member being less than the length of each ticket.

9. Processing apparatus according to claim 1, wherein the outlet receptacle comprises a temporary receptacle rotatably mounted on a plate of the coupling means and actuated by an electromagnet, said temporary receptacle maintaining the tickets to be extracted by holding their bottom portions.

10. Processing apparatus according to claim 1 and including an encoding station, wherein the drive means for at least one of the modules comprise a toothed belt pressing against wheels over which it is curved round a closed circuit, with pairs of adjacent wheels being spaced apart at a distance which is less than the length of a ticket, with the belt bypassing the encoding station via a return wheel to allow the ticket to be driven through the encoding means by a secondary belt, which is itself held taut over a plurality of wheels and which cooperates with the first belt by friction.

11. Processing apparatus according to claim 10, wherein the encoding station includes two magnetic heads, one for reading and the other for writing.

12. Processing apparatus according to claim 1, wherein the means for inserting card tickets into each module comprise two guide channels for tapes supplied from two respective reels, said guide channels converging towards each other.

13. Processing apparatus according to claim 1, including a print station, wherein the print means include a dot matrix printer facing a roll forming a print platen, with two wheels placed respectively upstream and downstream from the print means and with the module drive belt passing over said wheels, with printing being performed both along the length of the ticket which is then made to reciprocate repetitively, as well as across the width thereof.

14. Processing apparatus according to claim 1, wherein each module includes cutter means including a blade and a backing blade, said cutter means being actuated by an electromagnet.

* * * * *

UNITED STATES PATENT AND TRADEMARK OFFICE

CERTIFICATE OF CORRECTION

PATENT NO. : 4,812,060

DATED : March 14, 1989

INVENTOR(S) : Alain L. Pailler

It is certified that error appears in the above-identified patent and that said Letters Patent is hereby corrected as shown below:

Column 1, line 43, after "processing" insert -- apparatus --.
Column 1, line 44, change "more quickly" to -- quicker --.

Column 2, line 6, change "round" to -- around --.
Column 2, line 61, change "round" to -- around --.

Column 4, line 45, change "moment" to -- movement --.
Column 4, line 65, change "round" to -- around --.

Column 5, line 10, change "forwards" to -- forward --.
Column 5, line 22, change "82" to -- 182 --.
Column 5, line 28, change "acting" to -- action --.

Column 6, line 67, change "round" to -- around --.

Column 7, line 20, change "o± to -- of --.
Column 7, line 43, after "360" delete -- and --.
Column 7, line 68, change "above:" to -- above. --.

Column 8, line 1, change "pre-fabricated" to -- prefabricated --.
Column 8, line 8, after "example" insert a comma.
Column 8, line 21, change "pre-cut" to -- precut --.
Column 8, line 27, before "likewise" insert -- ( --.
Column 8, line 29, change "other" to -- another --.
Column 8, lines 43,44, change "Card ticket processing apparatus suitable for issuing and/or inspecting a ticket" to -- Card Ticket Processing Apparatus Suitable for Issuing and/or Inspecting a Ticket --.

UNITED STATES PATENT AND TRADEMARK OFFICE

CERTIFICATE OF CORRECTION

PATENT NO. : 4,812,060

DATED : March 14, 1989

INVENTOR(S) : Alain L. Pailler

It is certified that error appears in the above-identified patent and that said Letters Patent is hereby corrected as shown below:

Column 8, lines 45,46, change "Anvil print apparatus, in particular for travel tickets" to -- Anvil Print Apparatus, in Particular for Travel Tickets --.

Column 8, lines 47-49, change "Apparatus for processing card tickets, in particular travel tickets having a magnetic track" to -- Apparatus for Processing Card Tickets, in Particular Travel Tickets Having a Magnetic Track --.

In the Claims:

Column 10, line 18, change "round" to -- around --.

Signed and Sealed this

Seventh Day of November, 1989

*Attest:*

JEFFREY M. SAMUELS

*Attesting Officer*

*Acting Commissioner of Patents and Trademarks*